US010330406B2

(12) United States Patent
Christensen

(10) Patent No.: US 10,330,406 B2
(45) Date of Patent: Jun. 25, 2019

(54) FIREARM LOWER RECEIVER WITH NON-DETACHABLE MAGAZINE

(71) Applicant: Craig A. Christensen, Yuba City, CA (US)

(72) Inventor: Craig A. Christensen, Yuba City, CA (US)

( * ) Notice: Subject to any disclaimer, the term of this patent is extended or adjusted under 35 U.S.C. 154(b) by 0 days.

(21) Appl. No.: 14/756,092

(22) Filed: Jul. 30, 2015

(65) Prior Publication Data

US 2017/0227312 A1 Aug. 10, 2017

(51) Int. Cl.
*F41A 3/66* (2006.01)
*F41A 9/66* (2006.01)
*F41A 17/38* (2006.01)

(52) U.S. Cl.
CPC *F41A 3/66* (2013.01); *F41A 9/66* (2013.01); *F41A 17/38* (2013.01)

(58) Field of Classification Search
CPC ..... F41A 9/65; F41A 3/66; F41A 3/72; F41A 9/64; F41A 17/38; F41A 35/00; F41A 9/01; F41A 9/41
USPC ..... 42/18, 50, 49.01, 49.02
See application file for complete search history.

(56) References Cited

U.S. PATENT DOCUMENTS 894,530 A * 7/1908 Punches ..... F41A 3/32 42/22
3,019,542 A * 2/1962 Manthos ..... F41A 9/65 42/18
3,636,647 A * 1/1972 Goldin ..... F41A 9/69 206/3
4,472,900 A * 9/1984 Howard ..... F41A 9/69 42/50
4,601,124 A * 7/1986 Brown, Jr. ..... F41C 23/00 42/75.03
4,688,344 A * 8/1987 Kim ..... F41A 9/67 42/50
5,452,534 A * 9/1995 Lambie ..... F41A 9/71 42/18
5,900,577 A * 5/1999 Robinson ..... F41A 11/02 89/156
7,621,063 B2 * 11/2009 Fitzpatrick ..... F41A 9/70 42/50
7,854,083 B1 * 12/2010 Aalto ..... F41A 9/38 42/50
7,958,660 B2 * 6/2011 Fitzpatrick ..... F41A 9/65 42/50

(Continued)

*Primary Examiner* — Joshua E Freeman
*Assistant Examiner* — Bridget A Cochran

(57) ABSTRACT

A lower receiver for an AR15 type firearm is provided comprising a non-detachable magazine movable in the receiver between a first locked position where the firearm is ready for use (i.e. cocked and ready for firing) and a second non-operational position where the magazine is lowered sufficiently to open a window or aperture in the receiver enabling the user to load fresh shell cartridges into the magazine. A locking mechanism also is provided for controlling the position of the non-detachable magazine between the first and second positions. A child-proof lock further is provided to prevent undesired activation of the locking mechanism. Additionally, a novel locking plate disposed between the lower receiver's frame and the receiver's stock extension tube provides enhanced support for the extension tube and an accessory attachment point for a shoulder strap or sling.

5 Claims, 6 Drawing Sheets

(56) References Cited

U.S. PATENT DOCUMENTS

| | | | | |
|---|---|---|---|---|
| 8,689,475 | B2 * | 4/2014 | Battaglia | F41A 9/65 42/49.02 |
| 8,935,873 | B2 * | 1/2015 | Moretti | F41A 21/08 42/40 |
| 9,121,652 | B1 * | 9/2015 | Mangiameli | F41A 9/67 |
| 9,212,858 | B2 * | 12/2015 | Wilson | F41A 9/65 |
| 9,341,421 | B2 * | 5/2016 | Findlay | F41A 9/65 |
| 9,482,478 | B2 * | 11/2016 | Newman | F41A 17/38 |
| 9,506,702 | B2 * | 11/2016 | Visinski | F41A 3/66 |
| 9,506,711 | B2 * | 11/2016 | Gomez | F41A 21/48 |
| 9,651,327 | B2 * | 5/2017 | Hoon | F41A 17/38 |
| 9,660,644 | B2 * | 5/2017 | Buttolo | H03K 17/955 |
| 2004/0020092 | A1 * | 2/2004 | Christensen | F41A 9/61 42/49.01 |
| 2015/0075052 | A1 * | 3/2015 | Boyarkin | F41A 9/67 42/87 |
| 2015/0198395 | A1 * | 7/2015 | Visinski | F41A 3/66 42/6 |
| 2015/0316339 | A1 * | 11/2015 | Young | F41A 11/02 42/49.01 |
| 2016/0334177 | A1 * | 11/2016 | Green | F41A 3/66 |
| 2017/0227311 | A1 * | 8/2017 | Dove | F02C 7/185 |

* cited by examiner

FIG. 1
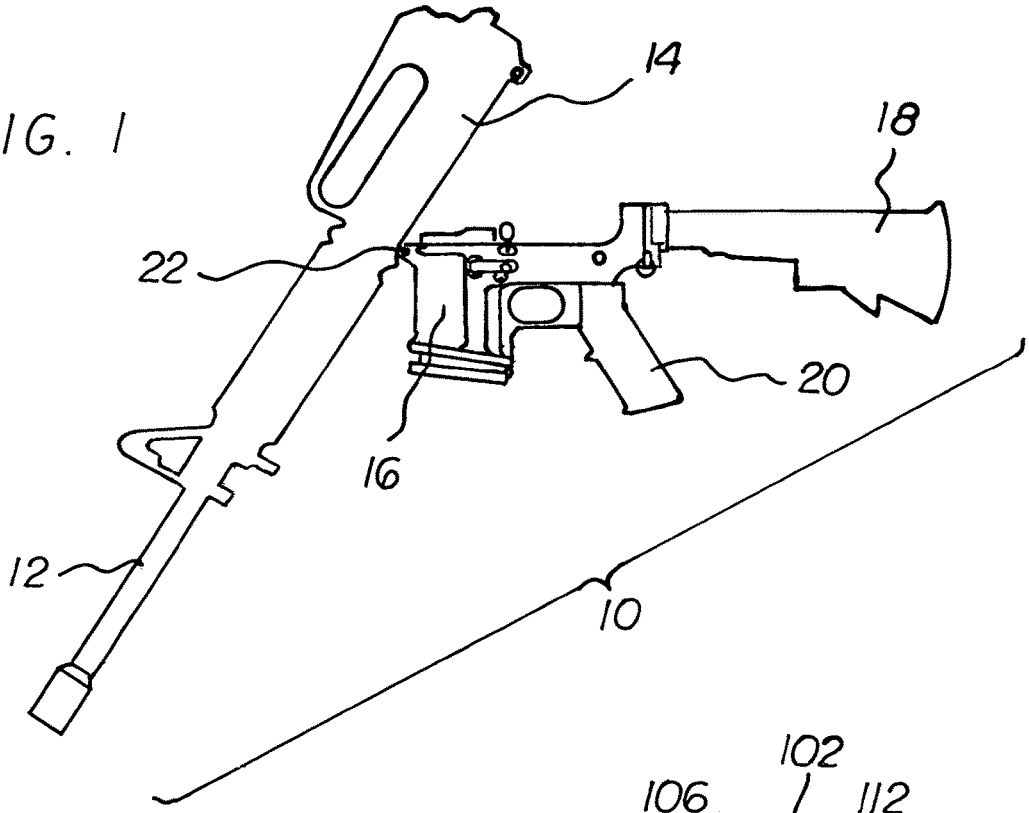
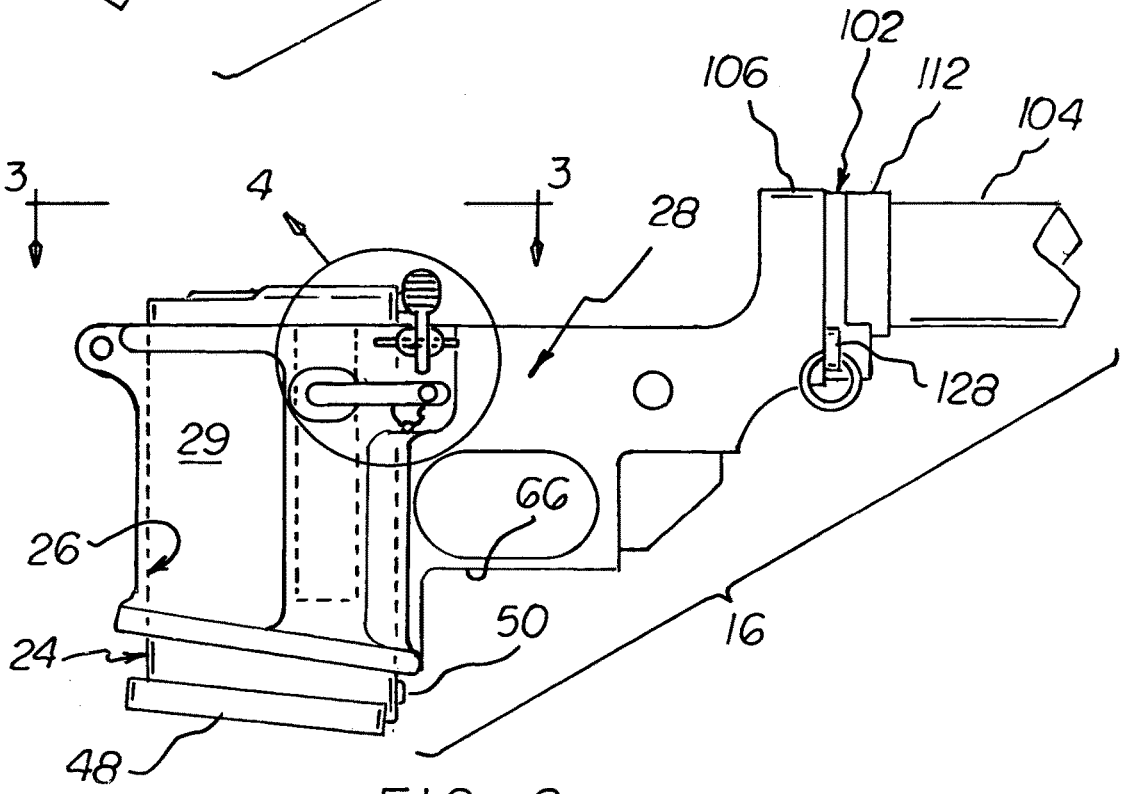
FIG. 2

FIG. 3
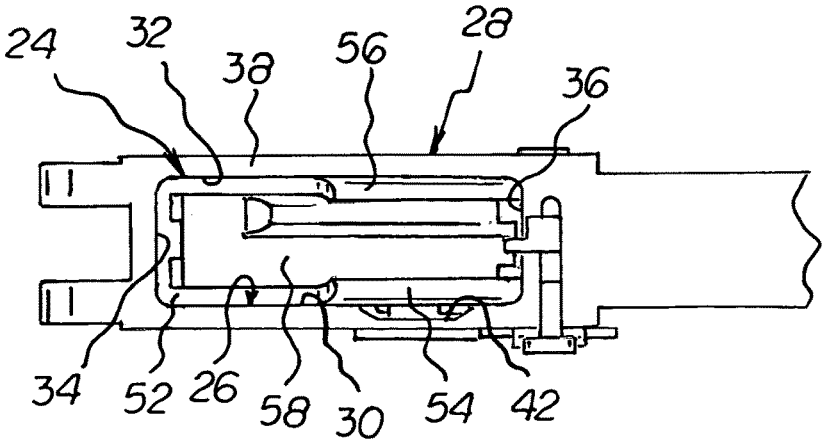
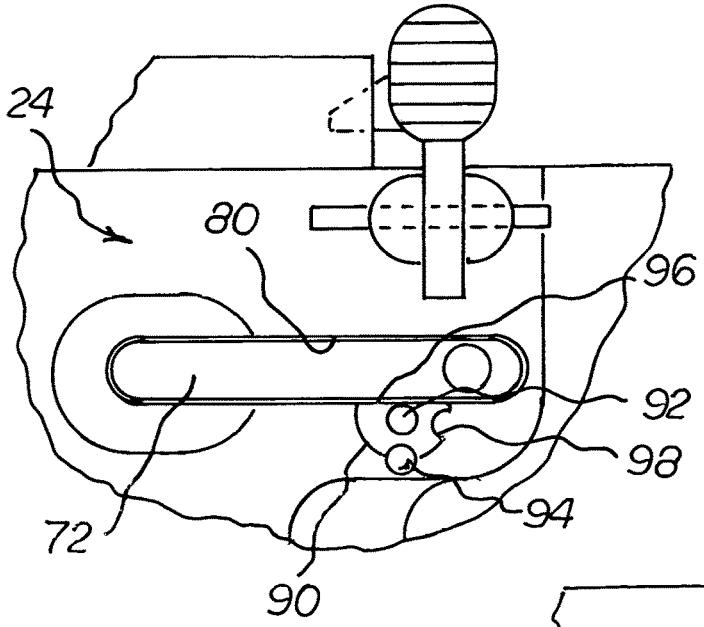
FIG. 4
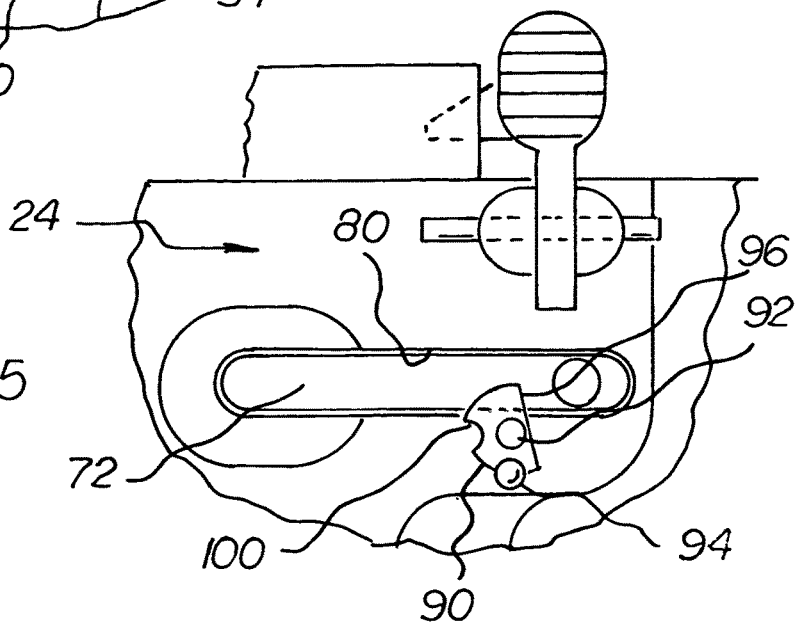
FIG. 5

FIG. 6A
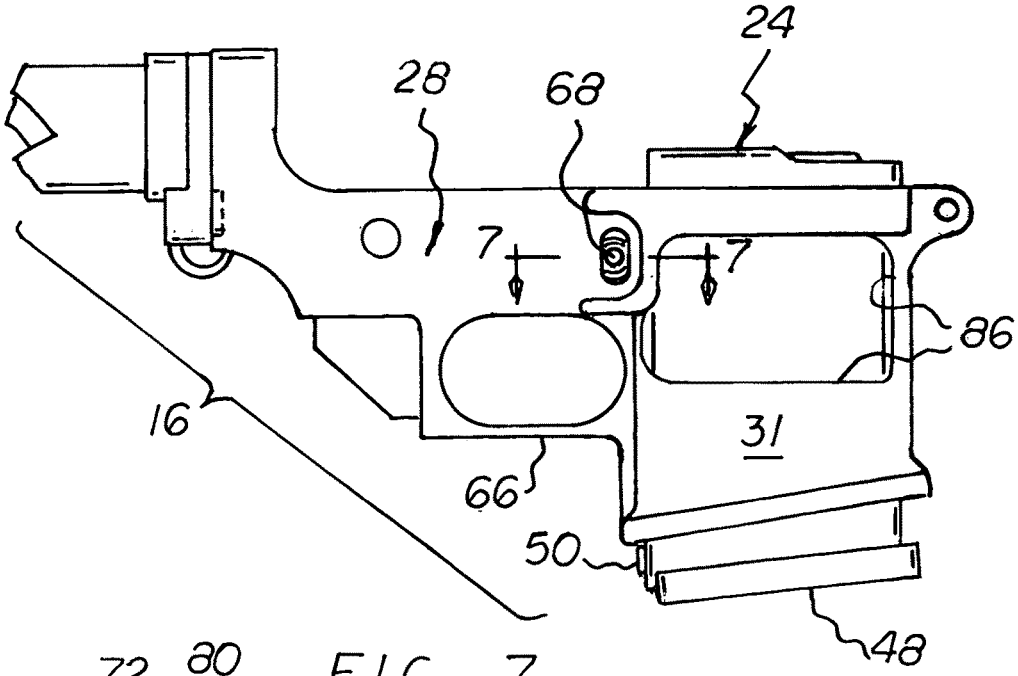
FIG. 7
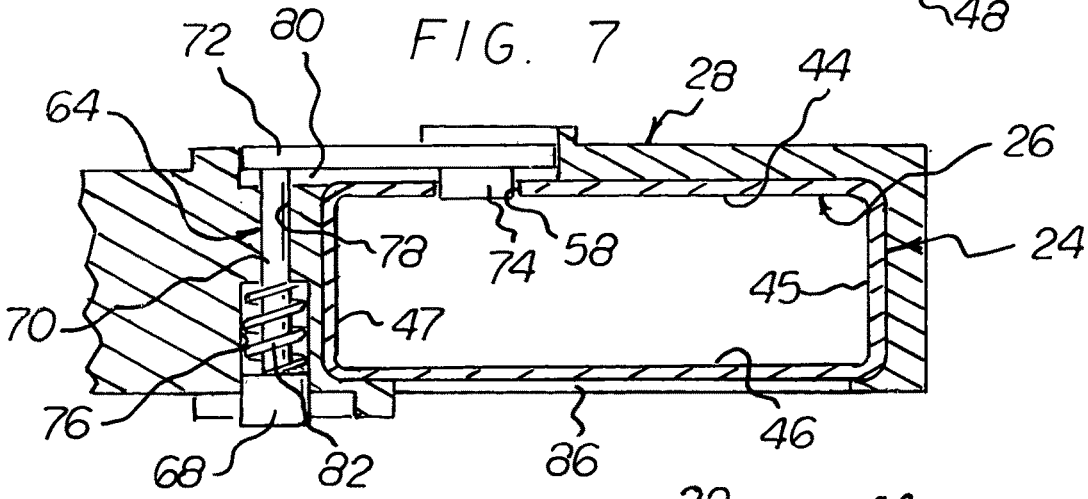
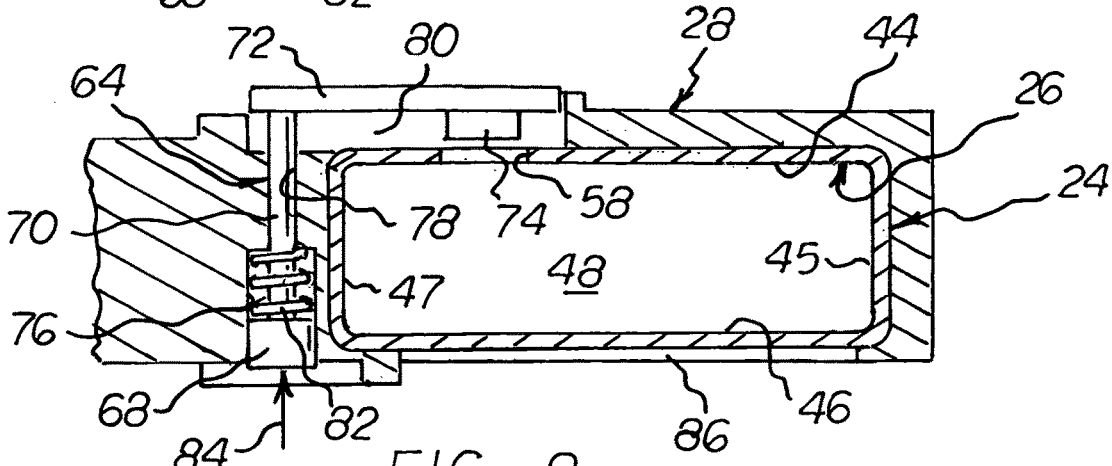
FIG. 8

FIG. 6B
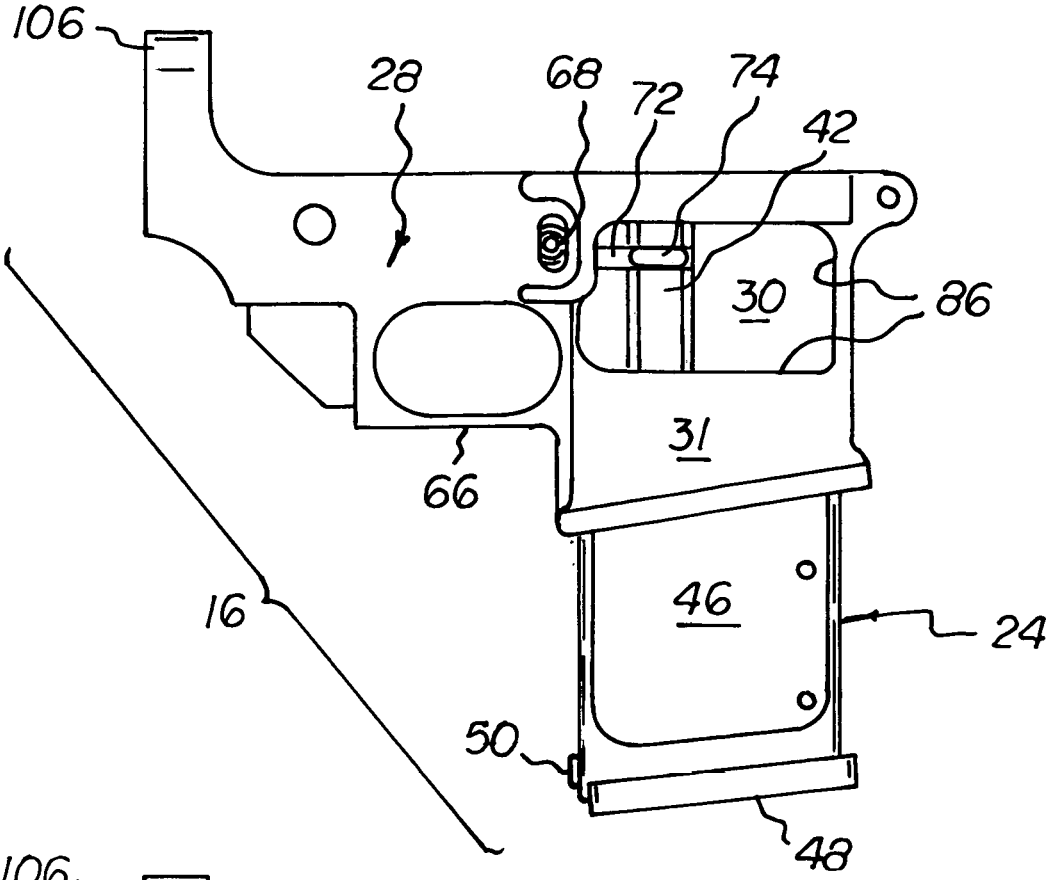
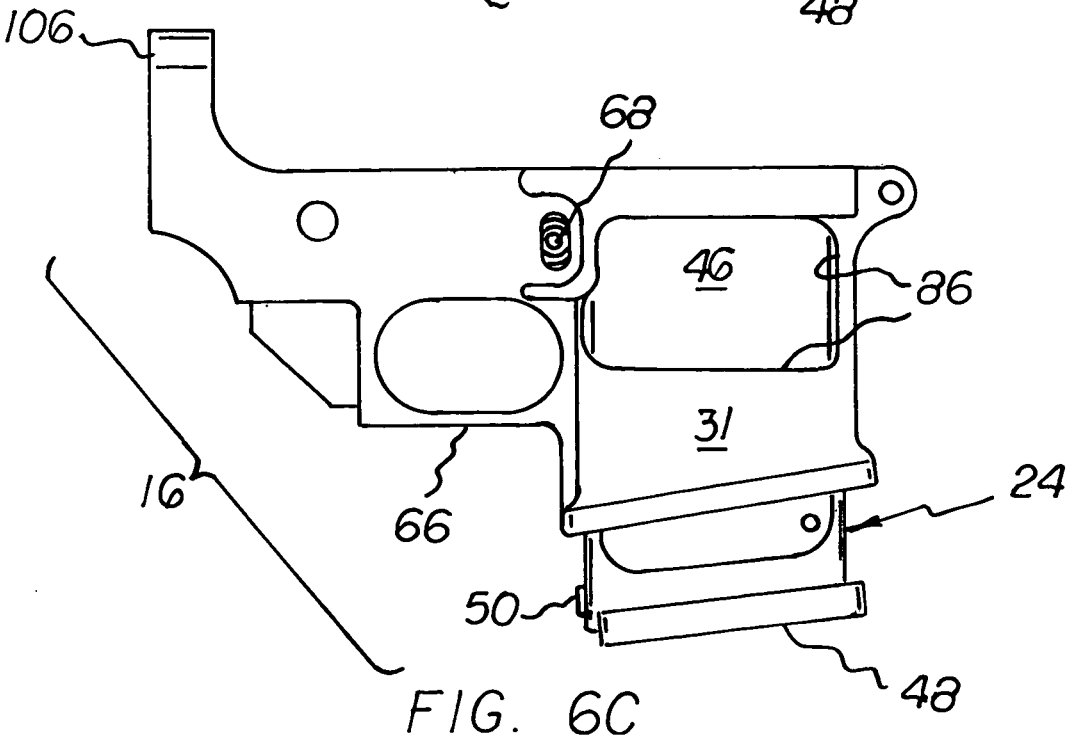
FIG. 6C

FIG. 9
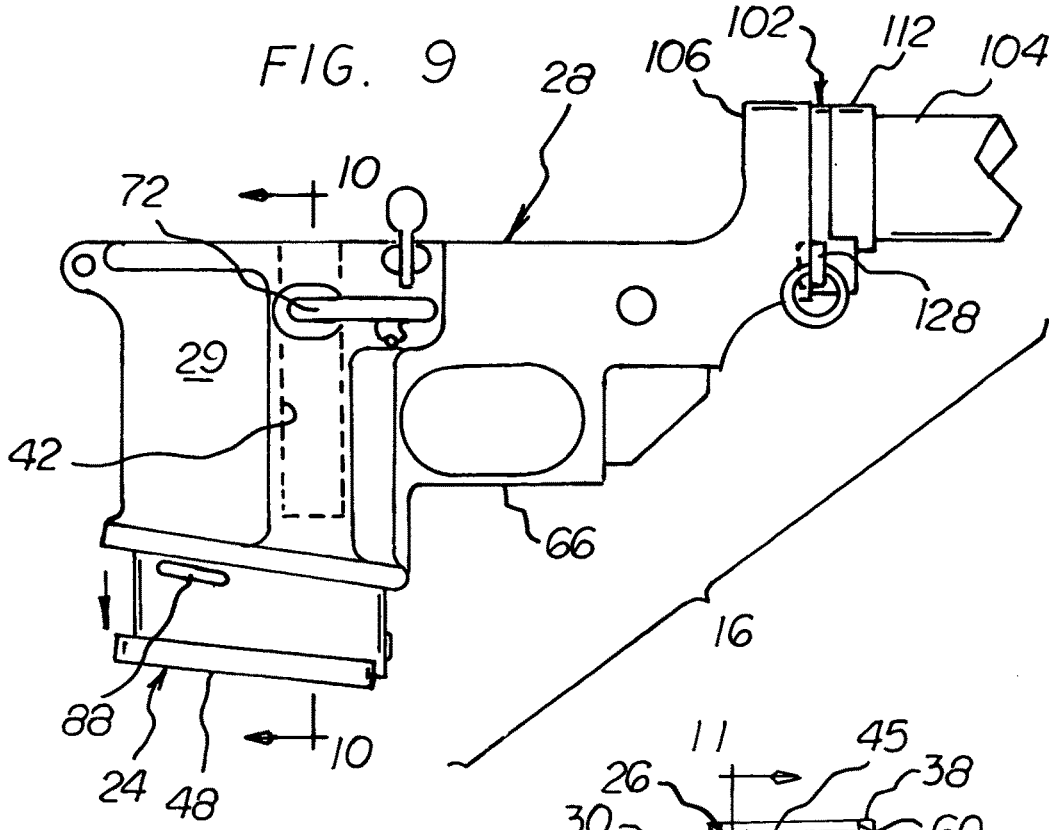
FIG. 10
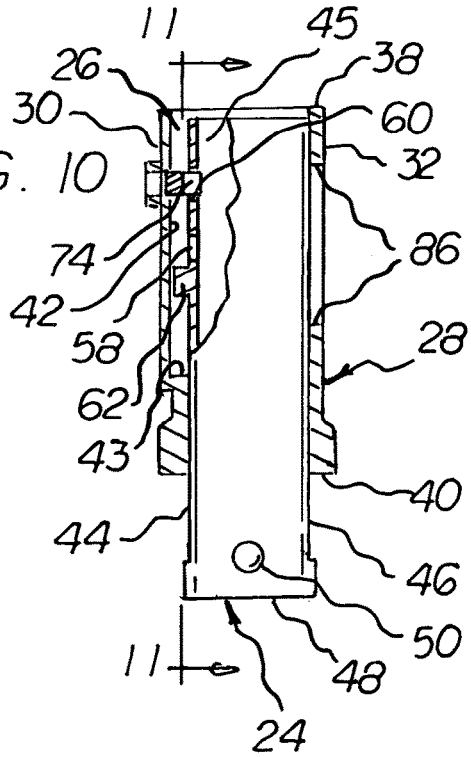
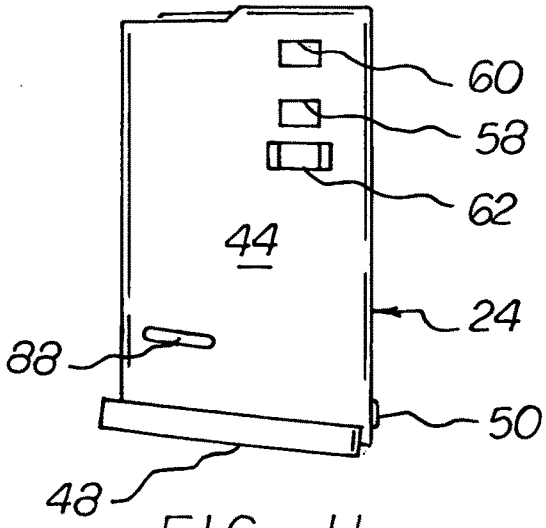
FIG. 11

FIREARM LOWER RECEIVER WITH NON-DETACHABLE MAGAZINE

CLAIM FOR PRIORITY

This application bases a claim of priority for all purposes on my prior provisional application Ser. No. 61/999,791, filed Nov. 5, 2014, which provisional application hereby is incorporated herein and made part of this application.

BACKGROUND OF THE INVENTION

Field of the Invention

The present invention relates generally to firearms and more specifically to improvements in the lower receiver of an AR-15 type firearm which has been modified so as to meet legal restrictions for the civilian use of such firearms.

Description of the Prior Art

The present invention relates generally to firearms of the well-known AR-15 type, and more particularly to AR15-type firearms that are modified to meet the many Federal and State rules and regulations restricting the availability and use of such equipment. In my prior patent, U.S. Pat. No. 6,739,082, entitled "Firearm With Fixed Cartridge Magazine Top," there is fully described an AR15-type firearm suitably configured to meet restrictive gun laws by, among other things, providing a lower receiver portion without a bottom opening for a magazine clip, and further providing a top-inserted magazine sized to receive no more than ten (10) cartridges. The entire disclosure of my prior '082 patent hereby is incorporated into this application and made part hereof by this reference. The firearm disclosed in my '082 patent, designated the "California FAB10," met with considerable commercial success because it included a detachable magazine and was able to feature the popular "pistol grip" while still complying with the restrictive gun laws on the books at that time. More recent changes to restrictive firearm laws have made it untenable to employ civilian AR-15 type firearms such as the prior art "FAB10" with both a detachable magazine and the enormously popular "pistol grip" feature. Additionally, in order to reload the prior art "FAB10," it was and is necessary to depress the "take down" pin and pivot the upper receiver open much like a double-barrel shot gun, a procedure most users found to be cumbersome and undesirable.

SUMMARY OF THE INVENTION

To overcome the forgoing and other disadvantages, the present invention, briefly summarized, comprises a lower receiver for an AR-15 type firearm, modified to meet legal restrictions, and characterized by a non-detachable magazine movable in the receiver between a first locked position where the firearm is ready for use (i.e. cocked and ready for firing) and a second non-operational position where the magazine is lowered sufficiently to open a window or aperture in the receiver enabling the user to load fresh shell cartridges into the magazine. The lower receiver further includes a locking mechanism for controlling the position of the non-detachable magazine between first and second positions by means of a depressible actuating button on one side of the receiver and a movable lock finger on the other side of the receiver. The lock finger is adapted to engage a recess in the magazine to lock it into the first position. Upon depression of the actuating button, the lock finger exits the recess releasing the non-detachable magazine for downward movement in the receiver. A child-proof lock further is provided to prevent the magazine lock finger from operating. Additionally, a novel locking plate disposed between the lower receiver's frame and the receiver's stock extension tube provides enhanced support for the extension tube and an accessory attachment point for a shoulder strap or sling.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the appended claims.

It is therefore a primary object of the present invention to provide a new and improved lower receiver apparatus for a firearm which has all of the advantages of the prior art and none of the disadvantages.

The forgoing and still other objects of the invention, along with the various features of novelty which characterize the invention, are pointed out with particularity in the claims annexed to and forming part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 1 is a side view in elevation showing a preferred embodiment of the firearm lower receiver apparatus of the invention installed in a complete firearm, between a firing unit, a stock and a pistol grip.

FIG. 2 is an enlarged elevational side view of the lower receiver apparatus shown in FIG. 1.

FIG. 3 is a top plan view taken along line 3-3 of FIG. 2.

FIG. 4 is an enlarged fragmentary side view in elevation of a portion of the lower receiver apparatus designated by circle 4 in FIG. 2 and showing a first unlocked lock position of the magazine lock assembly according to the invention.

FIG. 5 is an enlarged fragmentary side view in elevation of a portion of the lower receiver apparatus designated by circle 4 in FIG. 2 and showing a second locked position of the magazine lock assembly according to the invention.

FIG. 6A is an enlarged elevational view of the lower receiver apparatus of FIG. 1 showing the opposed other side of the receiver apparatus with the non-detachable magazine portion in a first fire-ready position.

FIG. 6B is an enlarged elevational view of the lower receiver apparatus of FIG. 1 showing the opposed other side of the receiver apparatus with the non-detachable magazine portion in a second non-fire-ready operational position and with the magazine loading window in an open position.

FIG. 6C is an enlarged elevational view of the lower receiver apparatus of FIG. 1 showing the opposed other side of the receiver apparatus with the non-detachable magazine portion in a third or intermediate non-fire-ready operational position.

FIG. 7 is a cross-sectional view taken along line 7-7 in FIG. 6A showing the magazine lock in an engaged locking position.

FIG. 8 is the same cross-sectional view taken along line 7-7 in FIG. 6A, but showing the magazine lock actuating button in a depressed condition such that the magazine is in an unlocked condition adapted for movement within the receiver apparatus.

FIG. 9 is an enlarged elevational side view of the lower receiver apparatus of FIG. 1 showing the magazine locked in an intermediate position within the receiver apparatus.

FIG. 10 is a cross-sectional view taken along line 10-10 of FIG. 9.

FIG. 11 is an elevational side view of the magazine portion of the lower receiver apparatus removed from the magazine and showing the two vertically spaced locking apertures and the stop lug thereon.

DESCRIPTION OF THE PREFERRED EMBODIMENT

Figure 12:
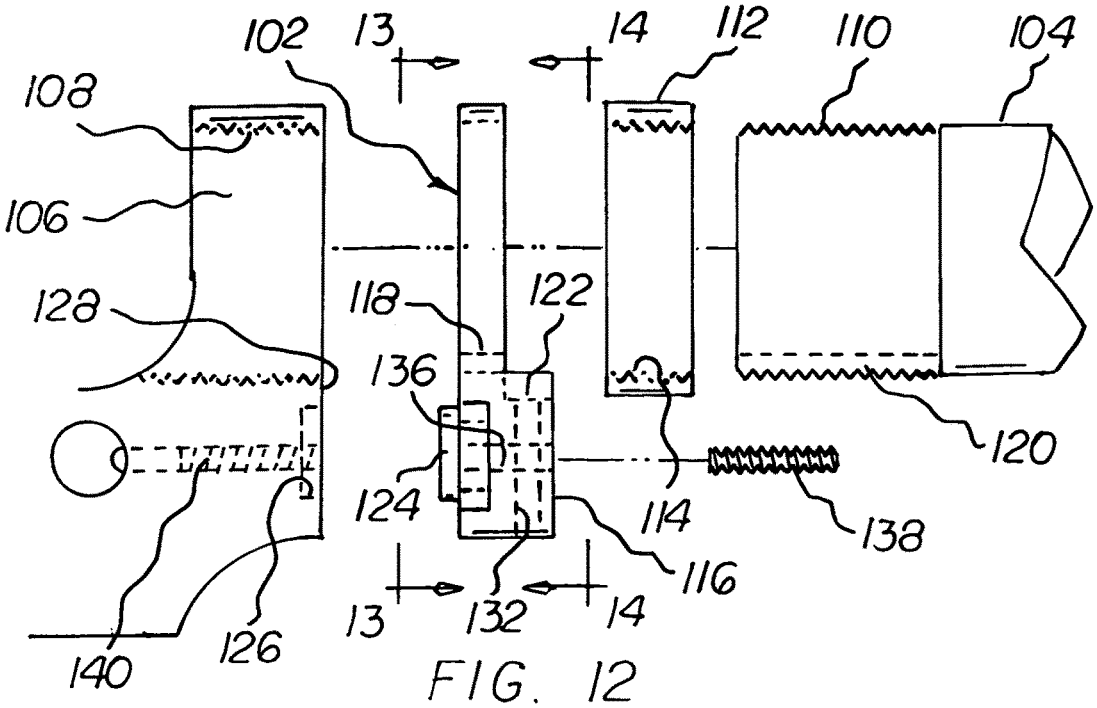
FIG. 12 is an exploded assembly view of the apparatus showing the novel locking plate according to the invention disposed between the stock extension tube and the receiver apparatus.

With reference to the drawings, a new and improved firearm lower receiver with non-detachable magazine apparatus embodying the principles and concepts of the present invention will be described.

Turning initially to FIG. 1, the improved firearm apparatus of the present invention generally is designated by reference sign 10 and comprises a barrel 12, a frame comprising an upper receiver 14 and a lower receiver 16, a stock 18, a pistol grip 20, and a firing mechanism. The upper receiver and the firing mechanism are well known in the art. The barrel 12 is fixedly attached to the upper receiver 14 as is also well known in the art and the upper receiver is pivotally attached to the lower receiver 16 at a hinge pin 22. The firing mechanism of the firearm includes a trigger and hammer assembly in the lower receiver 16, and a bolt carrier and bolt assembly longitudinally slidably mounted in the upper receiver 14. The upper receiver 14 also includes a takedown pin attached to the lower receiver 16 for fixedly attaching the upper receiver to the lower receiver. The firing mechanism and the takedown pin are not shown because these parts are well known in the art and outside the scope of the present invention.

Turning to FIGS. 2-11, in accordance with an important feature of the invention, the lower receiver 16 includes a non-detachable magazine assembly 24 mounted for limited slidable longitudinal movement in a magazine reception well 26 provided in a portion of the lower receiver's frame generally indicated by reference sign 28, which frame portion 28 thus provides a housing for the magazine assembly 24. The frame portion 28 has a first or left side 29 as viewed in FIGS. 2 and 9, and an opposed second or right side 31 as viewed in FIGS. 6A, 6B and 6C. As in the prior '082 patent, magazine assembly 24 suitably is sized and configured to retain and dispense no more than 10 cartridges. Additionally, magazine assembly 24 can include interiorly thereof the same or similar cartridge magazine spring and cartridge magazine follower arrangement shown in FIG. 3 of my '082 patent.

The magazine reception well 26 extends completely and longitudinally through the lower receiver frame portion 28 and is characterized by a generally quadrilateral transverse cross-sectional shape to define a passage for the magazine assembly 24 telescopically received therein. More specifically, the magazine reception well 26 is defined by a pair of opposed spaced apart side walls 30, 32 and a pair of opposed spaced apart end walls 34, 36, substantially as depicted. The walls extend longitudinally between a common top edge 38 and a common bottom edge 40. A concave channel 42 is provided in top edge 38 and the interior surface of side wall 30 extends longitudinally from the top or upper edge 38 of the magazine reception well toward the bottom edge 40. However, the channel 42 does not intercept the bottom edge; rather the channel terminates a distance above the bottom edge 40 of the magazine reception well 26 to define a lateral stop ledge or shoulder 43 recessed into the interior surface of side wall 30, substantially as shown in FIG. 10.

As mentioned, and as in my prior '082 patent, non-detachable magazine assembly 24 is hollow and suitably sized and configured to receive no more than ten cartridges of the type normally used in AR-15 style firearms. In a departure from the prior art, the magazine assembly 24 of the present invention is adapted to be nested telescopically inside the magazine reception well 26 and can be indexed longitudinally between first, second and third positions without pivoting open the upper receiver from the lower receiver, as will be further explained below. To facilitate such arrangement and action, magazine assembly 24 comprises a front wall 44, an opposed rear wall 46, a first side wall 45, and an opposed second side wall 47. A somewhat enlarged bottom panel 48 closes off and seals the bottom of the magazine. A tamper-resistant, hardened, non-removable security screw 50 is installed in magazine side wall 47 for preventing withdrawal of the magazine from the reception well in an upward direction. The security screw 50 is emplaced after the magazine is installed in the reception well to ensure that the magazine is and remains non-detachable from the lower receiver frame 28. The security screw 50 is such that it may only be removed by special cutting tools requiring mutilation and damage to the magazine.

The top of the magazine assembly is defined by an annular edge 52 and a pair of opposed, upright, slightly-bent-inwardly clips 54, 56 for receiving and holding a cartridge in place by snap-fitment therebetween as is well known in the art. A Delrin® cartridge follower platform 58 closes off the interior of the magazine and when the magazine is empty of cartridges, the follower platform 58 is resiliently urged against the underside of clips 54, 56 by a spring assembly (not shown) located interiorly of the magazine assembly between the bottom of the follower platform 58 and the floor defined by the bottom panel 48. Essentially, the top portion of the magazine assembly 24, the Delrin® follower platform 58 and the resilient spring are the same as or similar to that shown in FIG. 3 of my prior '082 patent and fully described therein.

It will be observed, in accordance with this invention, when the firearm is in the first or fire-ready position, the magazine assembly 24 has sufficient length so that the bottom portion thereof including bottom panel 48 extends below bottom edge 40 of the magazine reception well 26 of frame portion 28, substantially as depicted in FIGS. 1, 2 and 6A.

As best seen in FIGS. 10 and 11, the magazine assembly 24 includes on or in wall 44, a first locking aperture 58, a second locking aperture 60, and a protruding stop lug 62 with the first and second apertures 58, 60 and the stop lug 62 being located and spaced apart in longitudinal axial alignment substantially as depicted. It will be noted that the location of the imaginary longitudinal axis of the apertures 58, 60 and stop lug 62 coincides with the imaginary central axis of concave channel 42 when the magazine assembly 24 is disposed within the magazine reception well (FIGS. 1-3 and 6-11).

Turning to FIGS. 6A, 7 and 8, a lock-release assembly generally indicated by reference sign 64 is provided in the lower receiver 16 above trigger guard 66 and comprises a release button 68, a push-rod 70, a transverse extension member 72, and a locking finger 74. More specifically, a first transverse recess 76 having a bore of first size communicates with a second passage 78 of second size, which latter, in turn opens into a third transverse oblong or quadrilaterally-shaped recess 80 of third size. As shown in the drawings, the push-button 68 is disposed in the first recess 76; the push-rod 70 is disposed in the second passage 78; and the transverse extension member 72 and locking finger 74 are disposed in the third recess 80, respectively.

A spiral spring 82 surrounding the push-rod is seated in recess 76 substantially as depicted and functions to normally resiliently bias the lock release assembly 64 in the position shown in FIG. 7. In that position, the locking finger 74 is adapted to lockingly engage either first locking aperture 58 or the second locking aperture 60 in the wall 44 of magazine assembly 24 depending upon the relative longitudinal position of the magazine assembly 24 within the magazine reception well 26.

When the locking finger 74 lockingly engages the first locking aperture 58 in wall 44 of magazine assembly 24 (FIG. 7), the magazine assembly is resiliently-locked in the position shown in FIG. 6A. This is the first or fire-ready position of the firearm. Release of such locking engagement may be effected in accordance with the present invention by depressing button 68 in the direction of arrow 84 (FIG. 8). This action causes the button 68 to move in first recess 76 against the resilience of spiral spring 82, causing the push-rod to move laterally in second passage 78, which in turn causes the extension member 72 and locking finger 74 thereon to move laterally out of third recess 80 thereby withdrawing the locking finger 74 from the first locking aperture 58 in magazine assembly wall 46 and freeing the magazine for longitudinal movement within the magazine reception well (FIG. 8).

Another important feature of the present invention is the ability to load or re-load cartridges into the magazine assembly 24 even though the firearm is in the closed condition, i.e. the upper receiver is locked to the lower receiver by the takedown pin. Access to the top portion of the magazine assembly when the firearm is in such "closed" condition is provided by a suitably sized and configured magazine access window or aperture 86 located in the wall of the frame portion on one side thereof proximal to lock-release push-button 68 and trigger guard 66, substantially as depicted in FIGS. 6-8. In order to use access window 86 to load cartridges into magazine 24, the magazine must be in its third position as shown in FIG. 6B. To index the magazine 24 from say the first position of FIG. 6A to the third position of FIG. 6B, the push-button 68 is depressed in the direction of arrow 84 (FIG. 8), freeing the magazine 24 to fall via gravity toward the bottom of the reception well 26. The magazine 24 will come to rest when the protruding stop lug 62 engages the lateral stop ledge or shoulder 43 recessed into the interior surface of side wall 30. When this action occurs, the longitudinal travel of the magazine downward in the reception well 26 is arrested and magazine 24 remains via gravity in the third position of FIG. 6B. Access window 86 thus permits individual cartridges to be loaded into the top of the magazine 24 because in the third position of FIG. 6B the top portion of the magazine 24 is reposed slightly under the lower rim of the window 86. When the magazine 24 is re-loaded as desired, the magazine 24 ultimately can be slid upwardly in the reception well 26 until the locking finger 74 resiliently engages the first locking aperture 58 in magazine assembly wall 44 under the influence of spiral spring 82 in recess 76 and the magazine is returned to the first or "fire ready" position of FIG. 6A. Of course, it will be appreciated that when the magazine is longitudinally moved upward from the third position of FIG. 6B to the first position of FIG. 6A, the rear wall 46 of the magazine closes off and seals the access window 86.

In accordance with the invention, the magazine assembly 24 optionally is adapted to be parked in a second position substantially as shown in FIGS. 6C, 9 and 10. In this second position, the pair of opposed, upright, slightly-bent-inwardly cartridge-holding clips 54, 56 are located slightly below the common top edge 38 of the magazine reception well 26, and the locking finger 74 joined to transverse extension member 72 is adapted to lockingly engage the second or top locking aperture 60 in the wall 44 of magazine assembly 24 (FIG. 10). An index mark 88 preferably is provided suitably located on magazine assembly 24 more or less as depicted in FIGS. 9 and 11 to assist the user in moving magazine 24 to the second position, i.e. by aligning the index mark 88 with the common bottom edge 40 of the magazine reception well (FIG. 9). When this occurs, the locking finger 74 will be opposite the second locking aperture 60 such that release of the push-button 68 will cause the locking finger to enter the second locking aperture 60 and lock the magazine into its second position. It will be appreciated that by suitable operation of the locking-release push button 68, the slidable magazine assembly 24 may be moved within frame 24 "from" any of the first, second or third position of the magazine "to" any of the other remaining positions of the magazine 24. In the second position of the magazine 24, the firearm may be cycled without a cartridge in the bolt chamber and this condition is preferred particularly during storage of the apparatus.

Another important feature of the invention is the provision of a "childproof" safety lock assembly for preventing use of the firearm apparatus 10 by youngsters or the like. This feature is shown in FIGS. 4 and 5 and comprises a pivotal or rotatable locking disc 90 fixed to an axle pin 92 suitably captured for rotation in the frame 24, and a transversely protruding resilient detent 94 also suitably captured in frame 24. Locking disc 90 further includes a flat surface 96 and first and second peripheral notches 98, 100 substantially as depicted.

In the non-locking condition, disc 90 has its flat surface substantially parallel and in alignment with the bottom edge of third transverse oblong or quadrilaterally-shaped recess 80. With this state of affairs depicted in FIG. 4, disc 90 is locked into a static "non-locking" position by the engagement of detent 94 in the second notch 100 and the disc 90 therefore has no effect on the transverse movement of transverse extension member 72 and locking finger 74 in and out of recess 80 (i.e. see FIGS. 7 and 8). By pressing resilient detent 94 inward (into the plane of the paper as viewed in FIG. 4), disc 90 can be rotated clockwise via rotatable axle pin 92 to the "locking position" as viewed in FIG. 5 and held in a static "locking" position by the engagement of resilient detent 94 and the first notch 98. In that "locking" condition (FIG. 5), the disc effectively blocks movement of extension member 72 and locking finger 74 in and out of recess 80 (FIGS. 7 and 8). As a result, the lock-release assembly (push-button button 68) is dis-enabled, effectively locking the magazine in either the first or second position depending upon whether the locking finger 74 is engaged with first locking aperture 58 or second locking aperture 60 in wall 44 of magazine assembly 24.

Stated otherwise, operation of the childproof locking assembly to the "locked" condition shown in FIG. 5, is effective to "lock" the magazine within the reception well 26 in either the first position (FIG. 2) or in the second position (FIG. 9). The reason the locking assembly of FIGS. 4 and 5 is "childproof" is that it is relatively difficult to depress resilient detent 94 and cause the disc to rotate between its locking and non-locking positions. A sharp pointed instrument and manual dexterity are required to execute this action and most children and even some adults will have substantial difficulty doing so. It will be appreciated that to return the childproof safety lock to the "unlocked" condition of FIG. 4, the foregoing action is reversed, i.e. the detent 94 is depressed into the body of frame 24 preferably using a sharp-pointed device, and disc 90 is rotated counterclockwise (as viewed in FIGS. 4 and 5) about the imaginary rotation axis defined by pin 92 until flat surface 96 once again is in substantially parallel alignment with the bottom edge of third oblong recess 80, and the resilient detent 94 is lockingly engaged in second peripheral notch 100.

In summary, the present invention provides an AR-15 style firearm with a pistol grip feature and a non-detachable magazine obviating pivoting open the upper receiver from the lower receiver in order to reload cartridges into the non-detachable magazine. While it is still possible to use the takedown pin to pivot open the firearm, and remove the bolt assembly, the magazine still cannot be withdrawn through the top of the magazine reception well because of the aforementioned security screw 50, or through the bottom of the magazine reception well because of the action of the protruding stop lug 62 on the magazine engaging the lateral stop ledge or shoulder 43 recessed into the interior surface of side wall 30 of the magazine reception well.

Turning to FIGS. 2 and 12-14, still yet another important feature of the present invention is the provision of a novel, multi-purpose locking plate generally indicated by reference sign 102. Locking plate 102 functions to securely lock the receiver extension tube 104 to the extension tube collar 106 located conventionally on the rear portion of the lower receiver frame 24. The extension tube 104 (partially depicted) which houses the firearm's recoil spring and serves as an anchor for an attachable stock, and the collar 106 are well known in the art. In this regard, collar 106 includes a female-threaded bore 108 whereas extension tube 104 terminates in a complimentary, male-threaded plug portion 110. A conventional castle nut 112 also is provided having a female-threaded bore 114 suitably configured and sized to threadedly and complimentarily engage the male-threaded plug portion 110 of extension tube 104. As is well known in the art, the extension tube plug portion 110 is intended to be screw-threaded into engagement with the receiver collar via threaded bore 108, and the castle nut 112 threadedly engaged on the plug portion 110 is then tightened down against the collar 106 to securely lock these parts in place.

In accordance with the invention, and as substantially depicted in FIG. 12, novel locking plate 102 is interposed between the collar 106 and castle nut 112 for the general purpose of providing a more secure locking connection between these parts, and to achieve other advantages as will become more evident from the ensuing description.

Figure 13:
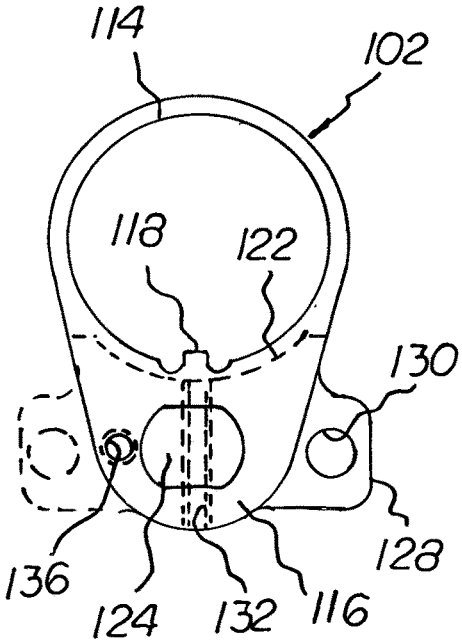
FIG. 13 is a front side view in elevation of the locking plate of FIG. 12 taken along line 13-13 of FIG. 12.
Figure 14:
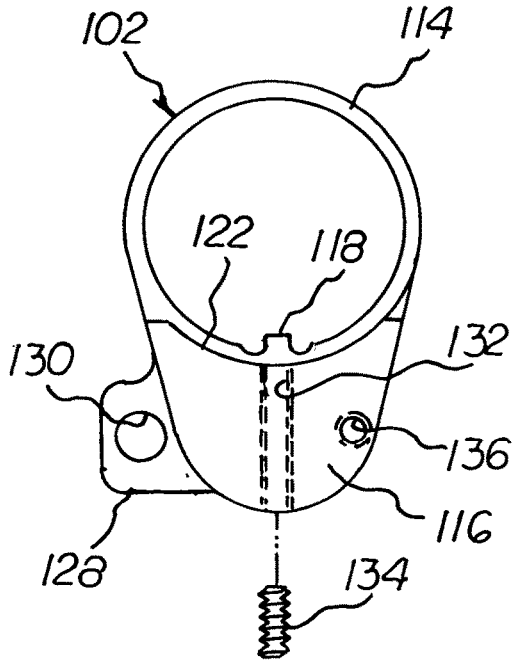
FIG. 14 is a rear side view in elevation of the locking plate of FIG. 12 taken along line 14-14 of FIG. 12.

As viewed in FIGS. 12-14, locking plate 102 preferably is of unitary one-piece construction and comprises an upper ring portion 114 and an integral lower enlarged portion 116. Upper ring portion 114, in turn, has an inner diameter suitably sized to permit the ring (and therefore the plate 102) to be slidingly received over the tube extension male-threaded plug portion 110. A tang 118 extends radially upward from the bottom of the ring portion 114 for ultimate mating engagement in a longitudinally extending keyway or slot 120 suitably provided in the outer surface of the extension tube plug portion 110.

The lower or bottom portion 116 of locking plate 102 is transversely enlarged as best depicted in FIG. 12 to define a curved (concave) supporting surface or seat 122 suitably sized and configured to engage the exterior or outer confronting surface of castle nut 112 when the latter is tightened down against the upper ring portion 114 and collar 106 (FIG. 2). To help maintain the upright orientation of the locking plate shown in FIGS. 12-14 when the parts are assembled (FIG. 2), the left side of the locking plate includes a protrusion or button 124 adapted to be received in a complimentary sized and configured recess 126 suitably formed in the rear surface 128' of the receiver frame 24 (FIG. 12).

Locking plate 102 further comprises a laterally extending integral tab 128 having an opening 130 for serving as an attachment point for a shoulder strap or sling. As indicated by the dashed outline in FIG. 13, the tab 128 and its defined opening 130 may optionally extend to the right or to the left depending upon the personal dictates of the user.

Additionally, as substantially depicted in FIGS. 13 and 14, locking plate 102 may be provided with a first female-threaded recess 132 extending vertically through lower or bottom portion 116 in substantial alignment with tang 118 and intercepting curved supporting surface or seat 122. A first male-threaded set screw 134 is threadedly engaged within first recess 132 and may be tightened against the castle nut 112 engaging supporting surface or seat 122 after the parts are assembled together. By this action, the locking plate 102 provides enhanced support for and secure locking engagement of the tightened-down castle nut 112.

Locking plate 102 preferably includes a second female-threaded recess 136 extending transversely through lower or bottom portion 116 for receiving a second male-threaded set screw 138. Second recess 136 aligns with a resilient detent 140 suitably seated in the frame 28 and which may be used conveniently for accessing the takedown pin when it is desired to pivot open the upper receiver from the lower receiver as is well known in the art.

In summary, the novel locking plate 102 of the present invention by providing a tang 118 adapted to engage keyway 120, and a button 124 adapted to be received in recess 126 of the rear surface 128 of the receiver frame 24, ensures that the receiver extension tube is maintained in proper alignment when the castle nut 112 is tightened, and provides enhanced support for the extension tube and the receiver's stock. Additionally, the locking plate 102 includes a first set screw 134 for tightening against the castle nut 112; provides a concave surface or seat 122 for providing enhanced support of the castle nut in its tightened condition; provides a second set screw for permitting access to the receiver's takedown pin without removing the castle nut and locking plate; and provides a convenient attachment point for a sling or strap.

The manner of usage and operation of the instant invention is believed apparent from the above disclosure, and accordingly, no further discussion relative to the manner of usage and operation need be provided.

The foregoing detailed description is considered as illustrative only of the principles of the invention. Numerous modifications and changes will readily occur to those skilled in the art and therefore, it is not desired to limit the invention to the exact construction and operation shown and described. Accordingly, all suitable modifications and equivalents falling within the broad scope of the subject matter described above may be resorted to in carrying out the present invention.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A firearm apparatus comprising in combination: a barrel, an upper receiver attached to said barrel, a lower receiver pivotally attached to said upper receiver, a pistol grip and a stock connected to said lower receiver, said lower receiver including a well therein, said well having a pair of opposed side walls extending longitudinally between a top portion of said lower receiver and a bottom portion of said lower receiver, a first opening in one of said opposed side walls of said well, a non-detachable cartridge magazine, said well having an open bottom end edge to define a bottom through passage, said non-detachable cartridge magazine being mounted for limited telescopic slidable movement up and down within said well between said pair of opposed side walls through said open bottom end edge defined bottom through passage, said non-detachable cartridge magazine having first and second opposed side walls, first and second opposed end walls, and a bottom wall defining a hollow interior space therein adapted to receive a predetermined number of cartridges, said non-detachable cartridge magazine further including a resilient cartridge follower affixed to said bottom wall within said hollow interior space, said non-detachable cartridge magazine defining a top opening for receiving cartridges within said hollow interior space in engagement with said resilient follower therein, said first opening in said opposed side wall of said well being in slidable registration with said top opening in said non-detachable cartridge magazine, said lower receiver further including a releasable locking mechanism adapted to selectively lock said cartridge magazine in a first position relative to said well where said firearm is ready to fire and said first opening and said top opening are not in registration, said lower receiver releasable locking mechanism being further adapted to selectively lock said cartridge magazine in a second position relative to said well characterized by said cartridge magazine being indexed to a lower longitudinal position within said well relative to said first position where said first opening in one of said opposed side walls is in registration with said top opening in said cartridge magazine to permit cartridges to be loaded into said cartridge magazine through said first opening and said top opening without pivoting open said upper receiver relative to said lower receiver, wherein said releasable locking mechanism is mounted in said lower receiver proximal to said lower receiver well, wherein said releasable locking mechanism includes a locking finger and a release button for actuating said locking finger, and wherein said locking finger is adapted to releasably lockingly engage said cartridge magazine whereupon activation of said release button causes said locking finger to disengage from said cartridge magazine to cause said cartridge magazine to telescopically move from its first position within said well to its second position within said well under the influence of gravity, wherein said one of said opposed side walls includes at least a first locking aperture disposed therein, said locking finger being suitably shaped and sized to lockingly and releasably engage said at least first locking aperture upon activation of said release button, wherein said pair of opposed side walls extending longitudinally between a top portion of said lower receiver and a bottom portion of said lower receiver to define said well comprises a first side wall and an opposed second side wall, wherein said first opening in one of said opposed side walls of said well is located in said first side wall, and wherein said locking finger is adapted to engage said at least first locking aperture on said cartridge magazine side wall through a recess in said opposed second side wall of said well, wherein said opposed second side wall of said well has an interior surface, and wherein a longitudinal concave channel is provided in said interior surface terminating a predetermined distance above said bottom end edge of said well to define a stop ledge within said well, and wherein said cartridge magazine opposed side wall including said at least first locking aperture further includes a protruding stop lug adapted to engage said stop ledge to limit slidable movement of said cartridge magazine longitudinally within said well between said first position and said second position, wherein said protruding stop lug is located a predetermined longitudinal distance from said at least first locking aperture in said one of said opposed side walls of said cartridge magazine to define said second position of said cartridge magazine in said well where said first opening in one of said side walls of said well is in registration with said top opening in said cartridge magazine to permit cartridges to be loaded into said cartridge magazine without pivoting open said upper receiver relative to said lower receiver, and wherein when said cartridge magazine telescopically moves between said first position relative to said well where said first opening and said top opening are not in registration, and said second position where said first opening in one of said side walls of said well is in registration with said top opening in said cartridge magazine to permit cartridges to be loaded into said cartridge magazine without pivoting open said upper receiver relative to said lower receiver, said resilient cartridge follower affixed to said bottom wall remains disposed within said hollow space defined by said telescopically movable cartridge magazine and moves together with said cartridge magazine between said first position and said second position without protruding from said lower receiver top portion when said movable magazine is in its second position relative to said well.

2. The apparatus of claim 1 wherein said at least first locking aperture and said protruding stop lug are axially longitudinally aligned on said cartridge magazine one of said opposed side walls.

3. The apparatus of claim 1 further including a second locking aperture in said cartridge magazine opposed side wall including said at least first locking aperture wherein said second locking aperture defines an intermediate position of said cartridge magazine in said well.

4. The apparatus of claim 3 wherein said at least first locking aperture, said second locking aperture and said protruding stop lug are axially longitudinally aligned on said cartridge magazine one of said opposed side walls.

5. The apparatus of claim 1 wherein said cartridge magazine is suitably sized and configured to retain and dispense no more than 10 cartridges.

* * * * *